US007456798B2

(12) United States Patent
Wong et al.

(10) Patent No.: US 7,456,798 B2
(45) Date of Patent: Nov. 25, 2008

(54) STACKED LOOP ANTENNA

(75) Inventors: Hang Wong, Kowloon (HK); Kwai Man Luk, West Kowloon (HK); Chi Hou Chan, Kowloon (HK); Quan Xue, Kowloon (HK)

(73) Assignee: Freescale Semiconductor, Inc, Austin, TX (US)

( * ) Notice: Subject to any disclaimer, the term of this patent is extended or adjusted under 35 U.S.C. 154(b) by 226 days.

(21) Appl. No.: 11/476,387

(22) Filed: Jun. 28, 2006

(65) Prior Publication Data

US 2008/0001840 A1 Jan. 3, 2008

(51) Int. Cl.
*H01Q 7/00* (2006.01)
*H01Q 21/28* (2006.01)

(52) U.S. Cl. ..... 343/742; 343/867

(58) Field of Classification Search ..... 343/806, 343/853, 895, 742, 867

See application file for complete search history.

(56) References Cited

U.S. PATENT DOCUMENTS 6,570,541 B2 * 5/2003 Dettloff ..... 343/742
2005/0113035 A1 5/2005 Kyongyop

FOREIGN PATENT DOCUMENTS

EP 1524723 A1 4/2005
EP 1555717 A1 7/2005

* cited by examiner

*Primary Examiner*—Michael C Wimer
(74) *Attorney, Agent, or Firm*—Charles Bergere

(57) ABSTRACT

A small transceiver device and antenna system has an insulating layer with first and second surfaces. A transmit loop element having transmit loop segments is formed on the first surface. The transmit loop segments are disposed in a transmit zigzag configuration. A receive loop element having receive loop segments is formed on the second surface. The receive loop segments are disposed in a receive zigzag configuration. Each receive loop segment in the receive zigzag configuration is skewed with respect to a closest transmit loop segment disposed in the transmit zigzag configuration. The transmit loop segments can be grouped in two or more transmit zigzag configurations, and the receive loop segments can be grouped in two or more receive zigzag configurations.

17 Claims, 4 Drawing Sheets

STACKED LOOP ANTENNA

BACKGROUND OF THE INVENTION

The present invention relates in general to antennas, and more specifically, to techniques and apparatus for stacking transmit and receive antennas formed on a substrate.

Engineers have recently been designing devices that enable interoperability of products within the home, office, and in factories using industrial automation. These devices can be monitored wirelessly via a network, and controlled based on an open global standard known as the IEEE 802.15.4 standard, which is promulgated by the IEEE (Institute of Electrical and Electronics Engineers). IEEE 802.15.4 specifies the physical communication layers for a low power, short range wireless communication link operating in the 2.4 GHz radio frequency band.

ZigBee is an additional standard-developed by the ZigBee Alliance association of companies, which defines logical network, security, and application software that operates using the 802.15.4 physical communication layer. ZigBee specifies high-level communication protocols that allow broad-based deployment of reliable wireless networks with low complexity and low costs, thereby facilitating the integration of various types of equipment from different vendors. ZigBee supports robust mesh networking technologies, where messages can choose a number of routes to get from one node to another, thereby increasing the reliability of the network. These types of networks typically are used for remote monitoring and control applications, and require very little power, which means that the network can run using inexpensive batteries.

ZigBee is designed to be simpler and less expensive than other wireless network devices, such as wireless personal area network (WPAN) devices (e.g., Bluetooth devices). One way to reduce the cost of such devices is to reduce the size and number of parts in the transceiver. At one level, the transceiver can be fabricated on a single small printed circuit board, where most of the transceiver components are contained in an integrated circuit. At another level, the transceiver can be a fully integrated single chip radio, including signal processing circuits, transmitter and receiver circuits, and an antenna, where all components of a transceiver are integrated into a single chip or integrated circuit. This idea is known as "system-on-a-chip" (SOC).

Whether on a printed circuit board, or in a single chip radio, or in some other embodiment, a small antenna system for transmitting and receiving signals can be an advantage. Smaller antenna systems can be less expensive to manufacture and easier to fit within the form factor of the products in which the transceiver is used.

BRIEF DESCRIPTION OF THE DRAWINGS

The accompanying figures, wherein like reference numerals refer to identical or functionally similar elements throughout the separate views and which together with the detailed description below are incorporated in and form part of the specification, serve to further illustrate various embodiments and to explain various principles and advantages, all in accordance with the present invention. The drawings are not always drawn to scale, but are, for example, enlarged, in order to facilitate a better understanding of the invention.

DETAILED DESCRIPTION OF THE INVENTION

In overview, the present invention concerns a small transceiver device having a compact antenna. More particularly, various inventive concepts and principles embodied in methods and apparatus may be used for making and using a small transceiver device having compact loop antennas.

While the antennas of particular interest may vary widely, one embodiment may advantageously be used in a wireless communication device or system, or a wireless networking system, such as a network of ZigBee compatible devices.

The instant disclosure is provided to further explain, in an enabling fashion, the best modes at the time of the application of making and using various embodiments in accordance with the present invention. The disclosure is further offered to enhance an understanding and appreciation for the inventive principles and advantages thereof, rather than to limit the invention in any manner. The present invention is defined by the appended claims, including any amendments made during the pendency of this application, and all equivalents of those claims as issued.

It is further understood that the use of relational terms, if any, such as first and second, top and bottom, and the like, are used solely to distinguish one entity or action from another without necessarily requiring or implying any such actual relationship or order between such entities or actions.

Some of the inventive functionality and inventive principles can be implemented with, or in, integrated circuits (ICs), or printed circuit board or other substrate technologies. It is expected that one of ordinary skill, when guided by the concepts and principles disclosed herein, will be readily capable of generating such substrates embodying the antenna systems described herein with minimal experimentation, notwithstanding possibly significant effort and many design choices motivated by, for example, available time, current technology, and economic considerations. Therefore, in the interest of brevity and minimization of any risk of obscuring the principles and concepts according to the present invention, further discussion of such substrate technologies, if any, will be limited to the essentials with respect to the principles and concepts of the various embodiments.

Figure 1:
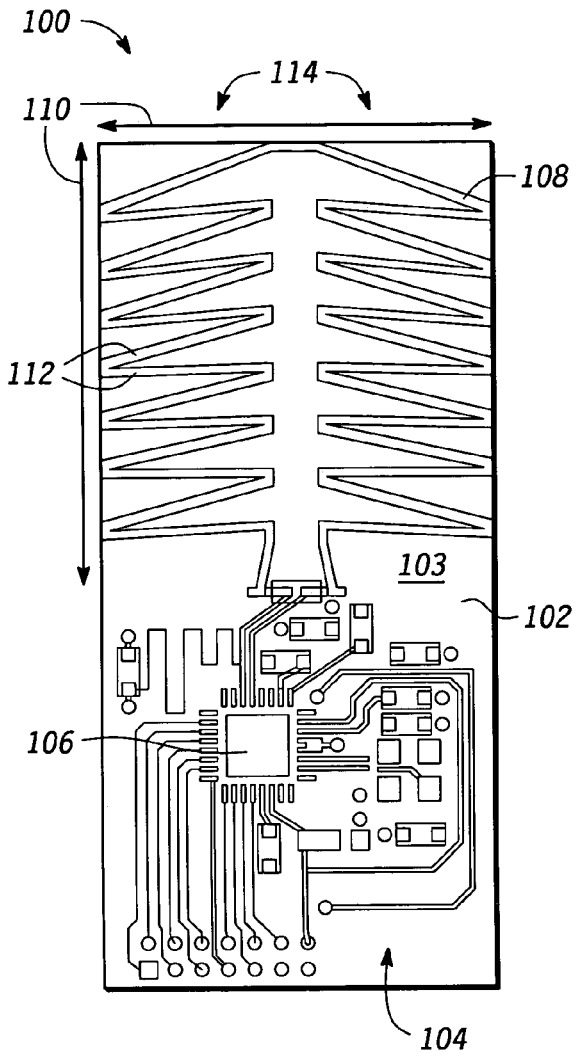
FIG. 1 depicts a first side of a transceiver device having a compact loop antenna system for transmitting in accordance with one or more embodiments of the present invention.

With reference now to FIG. 1, there is depicted a plan view of a first side of a transceiver device 100 having a compact loop antenna system for transmitting in accordance with one or more embodiments of the present invention. As illustrated, the transceiver device 100 is manufactured on a substrate 102, which, in the embodiment shown, is rectangular. In one embodiment, the substrate 102 is a printed circuit board (PCB) material, such as paper impregnated with phenolic resin (e.g., materials known by the designations XXXP, XXXPC, or FR-2), glass fiber impregnated with the proxy resin (e.g., material known by the designation FR-4), polyimide, polystyrene, cross-linked polystyrene, or other similar materials. In one embodiment, the substrate 102 is 0.8 millimeters (mm) thick, although the thickness can range from 0.5 mm to 2.0 mm, which is an approximate range of thicknesses of FR-4 PCB material.

In another embodiment, the substrate 102 may be made of a semiconductor wafer material, wherein the material has a low or acceptable, material loss, such as low loss tangent, low metallic loss, etc.

In the embodiment shown, the substrate 102 is planar. In other embodiments, the substrate 102 can have a curved surface. For example, the substrate 102 can be a flexible substrate material, which can be bent into a curved surface. Additionally, the substrate 102 can be a rigid material that is curved to conform to a shape of a product, or configured as part of the structure or housing of a product that uses the transceiver device 100.

On a first surface 103 of the substrate 102, circuit traces 104 are formed to connect various electronic components, such as a transceiver integrated circuit 106, to form the electrical circuitry of the transceiver device 100. The circuit traces 104 can be made of a conductive metal laminated to, or deposited on, a surface 103 of the substrate 102. In one embodiment, the metal can be copper. In other embodiments, the metal can be gold, silver, aluminum, copper, nickel, or other similar metals.

The transceiver integrated circuit 106 in one embodiment can be implemented with a 2.4 GHz, low power transceiver that operates in accordance with the IEEE 802.15.4 wireless standard, which supports star and mesh networking, or another similar wireless communication standard. An example of the integrated circuit 106 is the integrated circuit sold under part number MC13192 by Freescale Semiconductor, Inc., Austin, Tex., USA.

Other components mounted on a first surface 103 of the substrate 102 can include capacitors, inductors, a crystal for a crystal oscillator, etc.

Radio frequency outputs of the integrated circuit 106 can be coupled to feed points of a transmit loop element 108, which serves as the transmit antenna for the transceiver device 100. The transmit loop element 108 occupies a transmit loop area 110 (as illustrated by dimension lines), which in one embodiment is 15 millimeters (mm) by 15 mm (e.g., 225 $mm^2$). This can be one-half (½) of the area of the substrate 102, which, in the embodiment shown, measures 15 mm by 30 mm. The dimensions recited are for one embodiment that is arranged for operation at or around 2.4 GHz. It will be appreciated that other embodiments operating at other frequencies will have different dimensions. For example at lower frequencies, e.g., 2 GHz, these dimensions will be larger and at higher frequencies, e.g., 3 GHz, these dimensions can be smaller.

In order to reduce the transmit loop area 110 occupied by the transmit loop element 108, the transmit loop element 108 has a plurality of transmit loop segments 112 disposed in a zigzag configuration 114, or, as shown in FIG. 1, more than one transmit zigzag configuration 114.

Figure 2:
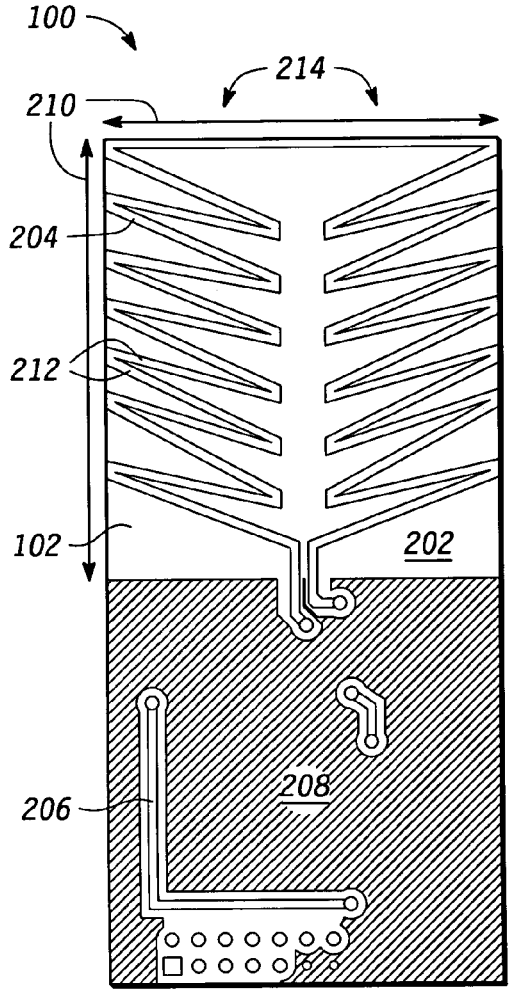
FIG. 2 depicts a second side of the transceiver device of FIG. 1 having a compact loop antenna system for receiving in accordance with one or more embodiments of the present invention.

With reference now to FIG. 2, there is depicted a plan view of a second surface 202 of the transceiver device 100, which has a compact loop antenna system for receiving in accordance with one or more embodiments. As illustrated, the second surface 202, which is opposite the first surface 103 (see FIG. 1), includes a receive loop element 204, circuit traces 206, and ground plane 208. The circuit traces 206 can electrically connect or couple components of the circuitry of the transceiver device 100. The ground plane 208 can serve as a near-field reflection point for the transmit loop element 108 and receive loop element 204, as well as providing a reference ground for the circuitry of the transceiver device 100.

The receive loop element 204 is formed on the second surface 202, and occupies a receive loop area 210 (indicated by dimension lines), which, in one embodiment, is an area (15 mm)$^2$ in the upper half of a 15 mm by 30 mm the substrate 102. In the embodiment shown in FIGS. 1 and 2, the receive loop area 210 and transmit loop area 110 are substantially the same shape and size, and are substantially directly opposite one another on opposite surfaces 103 and 202 of the substrate 102. Thus, for the embodiment shown, it may be said that orthogonal projections of the transmit loop area 110 and receive loop area 210 are coextensive, in that they have the same spatial boundaries.

The receive loop element 204 includes a plurality of receive loop segments 212, which, in order to reduce the received loop area 210, are disposed in a receive zigzag configuration 214, or, as shown in FIG. 2, more than one receive zigzag configuration 214.

Figure 3:
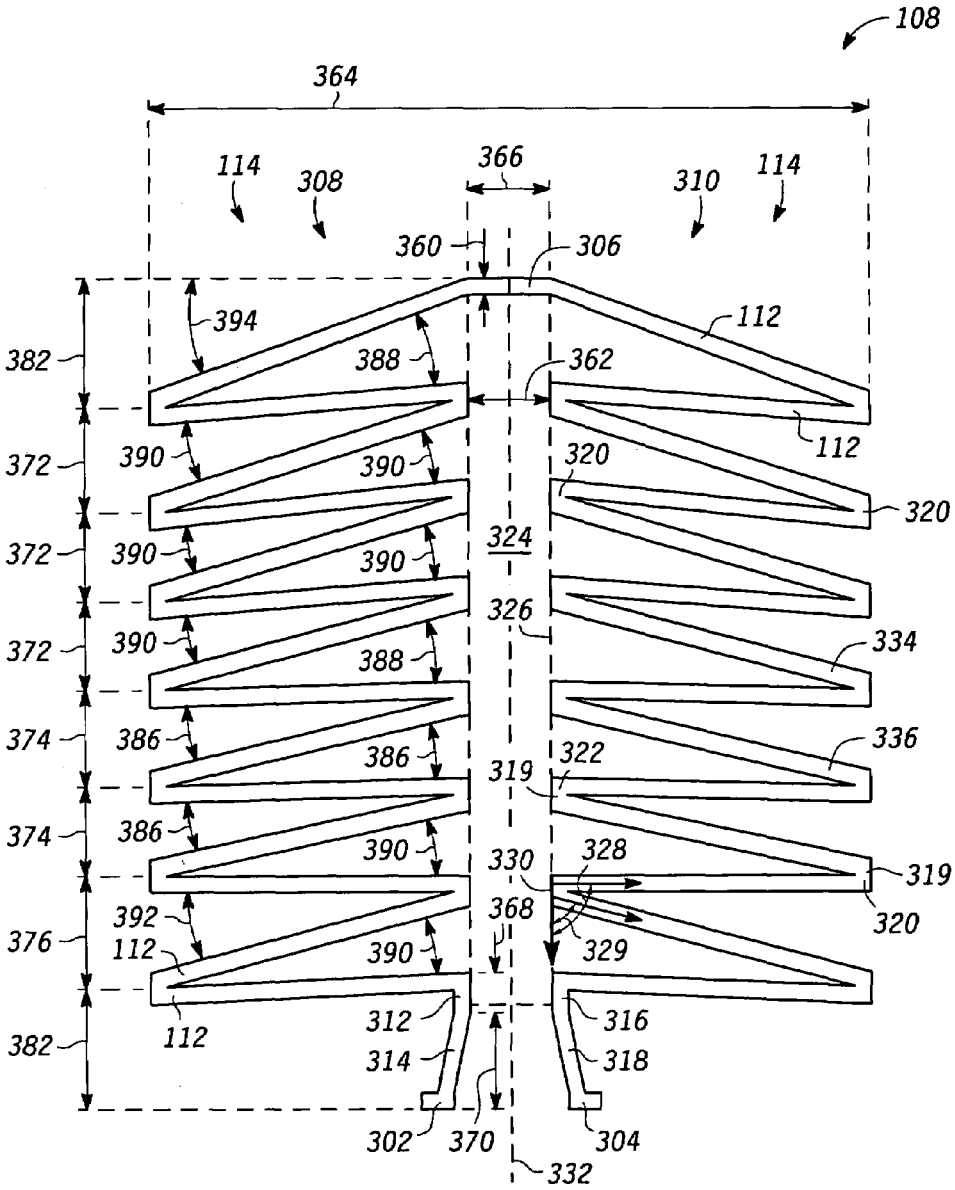
FIG. 3 is a more detailed representation of a transmit loop element in accordance with one or more embodiments of the present invention.

Referring now to FIG. 3, there is depicted a more detailed representation of a transmit loop element, such as the transmit loop element 108, or another similar loop antenna, in accordance with one or more embodiments. As illustrated, the transmit loop element 108 forms a continuous conductive loop, beginning at a feed point 302 and ending at a feed point 304. A plurality of transmit loop segments 112 are disposed in one or more transmit zigzag configurations 114. The example shown in FIG. 3 has two zigzag configuration groups 308 and 310, which are each formed with a plurality, or a group, of the transmit loop segments 112.

Some segments in the transmit loop element 108 may be referred to as transmit loop connecting segments, because they are used to connect to the transmit loop segments 112 that are disposed in the one or more transmit zigzag configurations 114. For example, the transmit loop connecting segment 306 can be used to connect the group 308 of transmit loop segments 112 to the group 310 of the transmit loop segments 112. The transmit loop connecting segments 312-318 can be used to connect the feed points 302 and 304 to the groups 308 and 310. Additionally, short transmit loop connecting segments 319 may be used at the vertices 320 and 322 (where a vertex is a point (as of an angle, polygon, polyhedron) that terminates a line or curve or comprises the intersection of two or more lines or curves). Such a vertex is formed where adjacent transmit loop segments 112 of the transmit zigzag configurations 114 meet. The purpose of the transmit loop connecting segments 319 is to ease or round the sharp corners at the vertices 320 and 322.

The transmit loop element 108 defines a central transmit loop area 324 in the center part of the loop. In the embodiment shown, the central transmit loop area 324 is rectangular, having a boundary 326 that is shown with a dashed line. In other embodiments, the central transmit loop area 324 can have other shapes.

The transmit loop segments 112 that are in transmit zigzag configurations 114 each extend away from the boundary 326 of the central transmit loop area 324 at an angle (e.g., angles 328 and 329) that is less than or equal to 90° from a first vector 330 having a first direction. For example, if the first vector 330 points downward, parallel to a central axis 332 of the central transmit loop area 324, each of the transmit loop segments 112 extending outward from the transmit loop area 324 forms an angle (e.g., angles 328 and 329) with reference to the first vector 330 that is less than or equal to 90°, thus producing the transmit loop segments 112 in the transmit zigzag configuration 114 that are either horizontal (e.g., at 90°) or sloped downward (e.g., less than 90°) toward the feed points 302 and 304.

Note that alternate segments (e.g., every other segment) in the zigzag configuration, such as segments 334 and 336, may or may not be parallel. As an example, the segment 334 is at a 75° angle with respect to the first vector 330, and the segment 336 is at an 80° angle with respect to the first vector 330, which means that the segments 334 and 336 are not parallel.

In one embodiment, the transmit loop segments 112 in the groups 308 and 310 are symmetrical about an axis 332, which is preferred for a design with differential inputs. The symmetrical shape provides a symmetrical radiation pattern about the axis 332. In other embodiments of the present invention, groups of loop segments need not be symmetrical about an axis.

Figure 4:
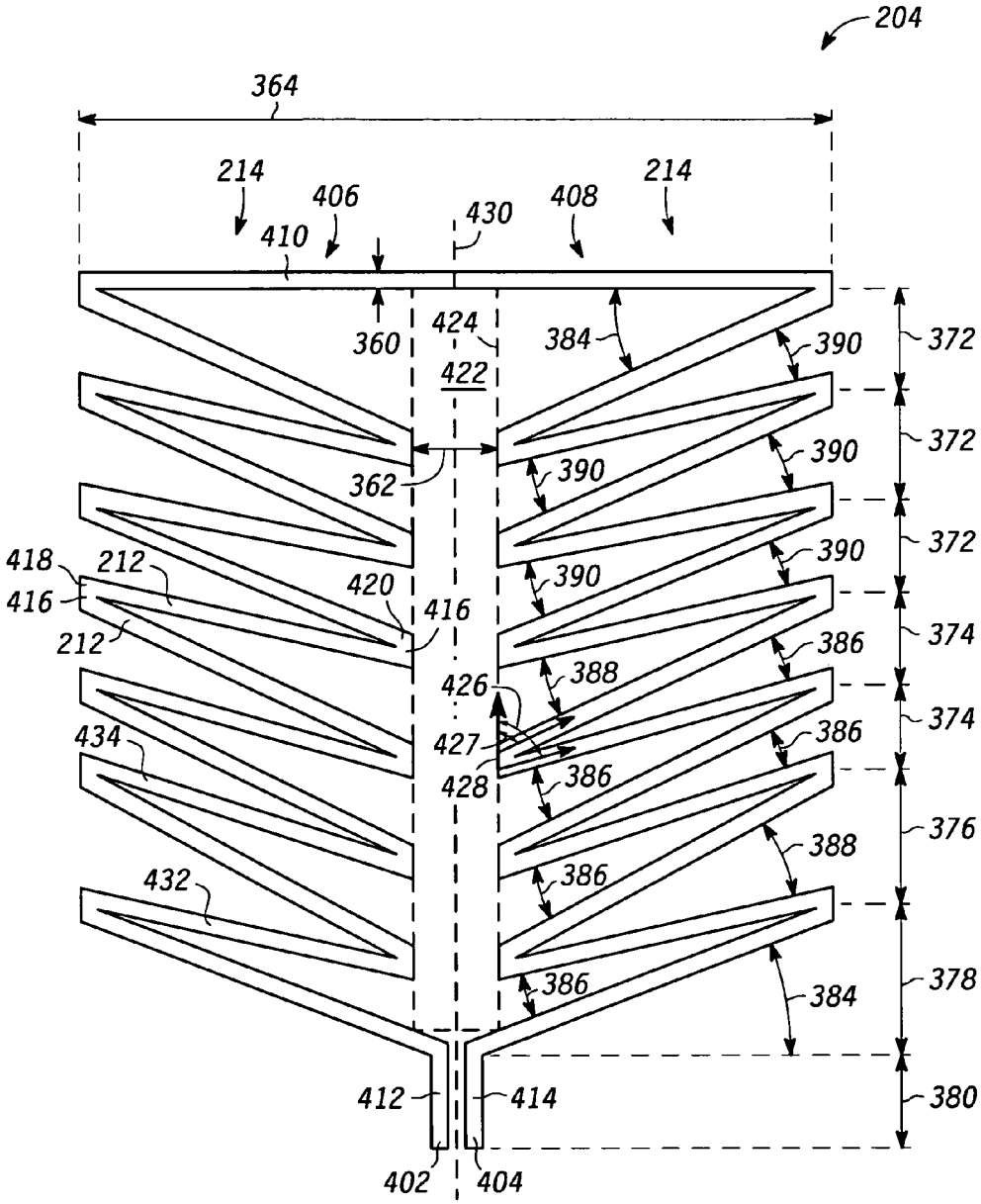
FIG. 4 is a more detailed representation of a receive loop element in accordance with one or more embodiments of the present invention.

In one embodiment of the present invention, the transmit loop element 108 has selected dimensions shown in the Table 1, below. Note that reference numbers 378 and 380 are shown in FIG. 4.

TABLE 1

| Reference Numeral | Dimension in Millimeters (mm) |
|---|---|
| 360 | 0.30 |
| 362 | 1.78 |
| 364 | 15.07 |
| 366 | 1.89 |
| 368 | 0.90 |
| 370 | 2.00 |
| 372 | 1.80 |
| 374 | 1.55 |
| 376 | 2.30 |
| 378 | 2.80 |
| 380 | 1.94 |
| 382 | 2.40 |

In one embodiment of the present invention, selected angles between transmit loop segments 112 in transmit zigzag configurations 114 are shown in Table 2, below.

TABLE 2

| Reference Numeral | Angle in degrees |
|---|---|
| 384 | 20 |
| 386 | 8 |
| 388 | 13 |
| 390 | 10 |
| 392 | 15 |
| 394 | 18 |

The transmit loop element 108 having the selected dimensions and angles in Tables 1 and 2 has an overall length of approximately 190 mm measured from the feed point 302 to the feed point 304, which is 1.55 times a wavelength at a center frequency of 2.42 GHz. Additionally, the transmit loop element 108 can fit within a square area that is 15 mm on a side.

Referring now to FIG. 4, there is depicted a more detailed representation of a receive loop element, such as the receive loop element 204, or another similar loop antenna, in accordance with one or more embodiments of the present invention. As illustrated, the receive loop element 204 is a continuous conductive loop, beginning at the feed point 402 and ending at the feed point 404. A plurality of receive loop segments 212 are disposed in one or more receive zigzag configurations 214. The embodiment shown in FIG. 4 has two zigzag configurations, 406 and 408, which are each formed with a plurality, or a group, of receive loop segments 212.

As similarly described above with reference to the transmit loop element 108, the loop element 208 in FIG. 4 can also have receive loop connecting segments, which are used to connect receive the loop segments 212 disposed in the one or more receive zigzag configurations 214. For example, the receive loop connecting segment 410 is used to connect zigzag elements in the group 406 to zigzag elements in the group 408. The receive loop connecting segments 412 and 414 can be used to connect the feed points 402 and 404 to the zigzag element groups 406 and 408, respectively. Additionally, the short receive loop connecting segments 416 can be used at the vertices 418 and 420, which are near the ends of adjacent receive loop segments 212 in the receive zigzag configurations 214. The receive loop connecting segments 416 can be used to ease, or round, the sharp corners of the zigzag configuration.

The receive loop element 204 defines a central receive loop area 422 in the center part of the receive loop. In the embodiment shown, the central receive loop area 422 is rectangular, with a boundary 424 shown as a dashed line. In other embodiments, the central receive loop area 422 can have other shapes.

The receive loop segments 212 that are in receive zigzag configurations 214 each extend away from the boundary 424 at an angle (e.g., angles 426 and 427) that is less than 90° from a second vector 428, wherein the second vector 428 is in a direction opposite to the first vector 330. For example, the second vector 428 points upward parallel to receive loop axis 430, and each receive loop segment 212 extends outward from the central receive loop area boundary 424, forming an angle with the second vector 428 that is less than 90°, thus creating the receive loop segments 212 disposed in one or more receive zigzag configurations 214, where such segments slope upward (e.g., angles 426 and 427 are less than 90°), away from the feed points 402 and 404.

Note that alternate receive loop segments in the receive zigzag configurations 214, such as the segments 432 and 434, may or may not be parallel. In the embodiment shown, the segment 432 extends away from the boundary 424 at an angle of 10° with respect to the second vector 428, while the segment 434 extends away from the boundary 424 at an angle of 15° with respect to the second vector 428, which means that the segments 432 and 434 are not parallel. Other pairs of alternate segments in FIG. 4 may be parallel.

In one embodiment, the receive loop segments 212 in the groups 406 and 408 are symmetrical about the receive axis 430. In other embodiments, groups of segments in zigzag configurations need not be symmetrical about an axis.

In one embodiment, the receive loop element 204 has selected dimensions that are listed in Table 1, above. The selected angles between the receive loop segments 212 in the receive zigzag configurations 214 are listed in Table 2, above.

Figure 5:
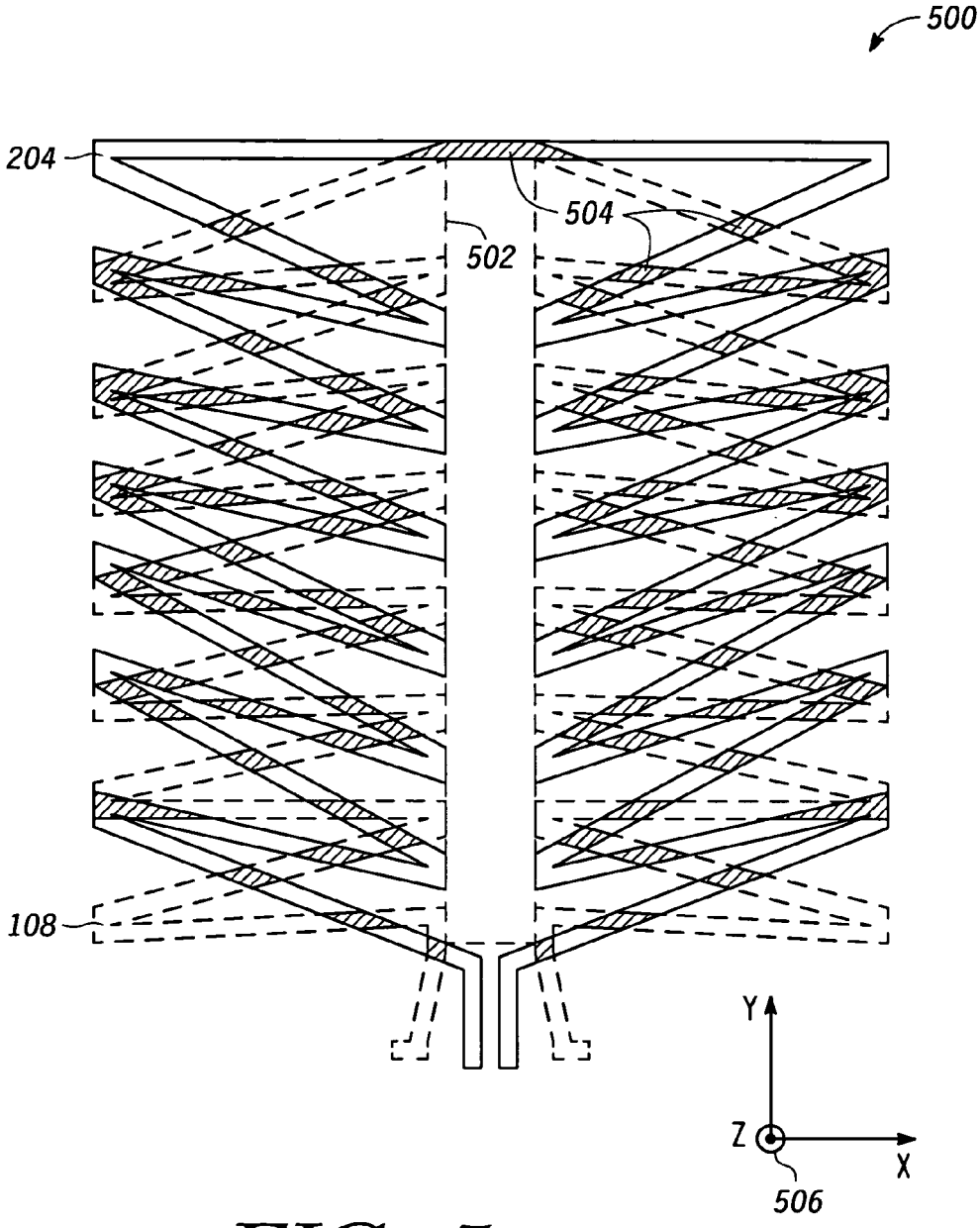
FIG. 5 depicts an orthographic projection of the transmit loop element upon the receive loop element in accordance with one or more embodiments of the present invention.

Turning now to FIG. 5, there is depicted an orthographic projection 500 of the transmit loop element 112 upon the receive loop element 212, which helps to illustrate a spatial relationship between the two loop antennas in accordance with one or more embodiments. As noted above, the transmit loop element 112 is on the first surface 103 of the substrate 102, and the receive loop element 212 is on the second surface 202 of the same substrate 102. Thus, if the transmit loop element 112 is orthographically projected onto the receive loop element 212 it produces a two dimensional image similar to that shown in FIG. 5. An orthographic projection 500 shows the alignment of the two loop antennas along a z-axis 506, which is an axis perpendicular to the plane of the substrate 102 (and first and second surfaces 103 and 202). If either the first or second surfaces 103 or 202 are not planar, then the z axis is normal to the surface.

As illustrated, the transmit loop element 108 (shown with a dashed line) and receive loop element 204 (shown with a solid line) occupy generally the same area on their respective surfaces. In the embodiment shown, they both fit within a 15 mm×15 mm square area. Boundaries 326 and 424 (See FIGS. 3 & 4) are substantially aligned along the z-axis and generally coincide in size and shape, as shown by the central area boundary 502.

FIG. 5 also shows that the area of overlap between the transmit loop element 108 and receive loop element 204 is relatively small, as indicated by the area of cross-hatched areas 504. The purpose of reducing the overlapping areas 504 is to reduce electrical coupling between the transmit loop element 108 and receive loop element 204 at the operating frequency of the transceiver 100. Reducing the electrical coupling reduces the radiation interference between the loop antennas.

The area of overlap 504 is reduced by configuring the transmit loop segments 112 and receive loop segments 212 that are close to each other so that they are skew, which means that they are set, placed, or run obliquely with respect to each other, or that they are slanting with respect to the other. It can also be said that the transmit loop segments 112 and the complimentary or corresponding receive loop segment 212 are not coextensive, or do not have substantially the same orthographic projection or intersection, wherein such complimentary or corresponding segments are opposite one another on either side of the substrate 102, are related through the symmetry of the transmit loop element 108 and receive loop element 204, and are a pair of elements most likely to electrically couple with one another due to orientation and proximity. Thus, the transmit loop segment 112 and corresponding receive loop segment 212 are not parallel.

It should be apparent to those skilled in the art that the method and system described herein provides a number of improvements over the prior art. First, the transmit loop element 108 and receive loop element 204 are compact and occupy small areas 110 and 210, respectively. Compact antennas reduce the overall size of the transceiver 100, which can reduce manufacturing cost and make the transceiver 100 easier to locate within a device or apparatus that is to be connected to a wireless network. The size of the stacked antennas is reduced without significantly reducing the gain of either antenna.

As a second advantage, a separate transmit loop element and receive loop element eliminates the need for a balun or a radio frequency (RF) switch in the transceiver device 100. A balun is a device designed to convert between balanced and unbalanced electrical signals, and an RF switch can be used to alternately connect a single loop antenna between a transmitter and a receiver.

As a third advantage, the stacked antenna configuration can be ideal for coupling to the differential input and output of the integrated circuit radio 106 in the transceiver 100, which works best with a 100 ohm impedance match.

The processes, apparatus, and systems, discussed above, and the inventive principles thereof are intended to produce a more effective compact transceiver system. By stacking compact transmit and receive loop antennas, a small transceiver device can be produced that has better antenna gain and radiation efficiency than a dipole or other differential input antenna. Additionally, by skewing corresponding zigzag elements in the transmit and receive loops, reduced electrical coupling and additional efficiency are achieved.

This disclosure is intended to explain how to fashion and use various embodiments in accordance with the invention, rather than to limit the true, intended, and fair scope and spirit thereof. The foregoing description is not intended to be exhaustive or to limit the invention to the precise form disclosed. Modifications or variations are possible in light of the above teachings. The embodiment(s) were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

The invention claimed is:

1. A small device antenna system for a transceiver, comprising:

an insulating layer having first and second opposing surfaces;

a transmit loop element on the first surface, wherein the transmit loop element has a plurality of transmit loop segments disposed in a transmit zigzag configuration; and a receive loop element on the second surface, wherein the receive loop element has a plurality of receive loop segments disposed in a receive zigzag configuration, wherein each receive loop segment in the receive zigzag configuration is skew with respect to a closest transmit loop segment disposed in the transmit zigzag configuration, wherein the transmit loop segments in the transmit zigzag configuration extend away from a boundary of a central transmit loop area at a transmit segment angle less than or equal to ninety degrees from a first vector in a first direction, and wherein the receive loop segments in the receive zigzag configuration extend away from a boundary of a central receive loop area at a receive segment angle less than ninety degrees from a second vector in a second direction that is opposite the first direction.

2. The small device antenna system of claim 1, wherein the transmit loop segments disposed in the transmit zigzag configuration are connected by transmit loop connecting segments, and wherein the receive loop segments disposed in the receive zigzag configuration are connected by receive loop connecting segments.

3. The small device antenna system of claim 1, wherein the transmit loop element has transmit loop segments grouped in two or more transmit zigzag configurations, and wherein the receive loop element has receive loop segments grouped in two or more receive zigzag configurations.

4. The small device antenna system of claim 1, wherein the central transmit loop area and the central receive loop area are rectangular.

5. The small device antenna system of claim 1, wherein the transmit loop element is in a transmit loop plane, and wherein the receive loop element is in a receive loop plane.

6. The small device antenna system of claim 5, wherein the transmit loop plane, and the receive loop plane are parallel.

7. The small device antenna system of claim 1, wherein every transmit loop segments disposed in the zigzag configuration is skew with respect to a corresponding one of the receive loop segments disposed in the zigzag configuration.

8. A small device antenna system for a transceiver, comprising:

a transmit loop element on a first side of an insulating layer, wherein the transmit loop element has a plurality of transmit loop segments disposed in a transmit loop zigzag configuration, wherein each of the plurality of transmit loop segments has a transmit segment angle with respect to a reference vector; and a receive loop element on an opposite side of the insulating layer, wherein the receive loop element has a plurality of receive loop segments disposed in a receive loop zigzag configuration, wherein each of the plurality of receive loop segments has a receive segment angle with respect to the reference vector, and wherein the receive segment angle of each receive loop segment is different from the transmit segment angle of a nearest transmit loop segment to reduce electrical coupling between the transmit loop element and the receive loop element.

9. The small device antenna system of claim 8, wherein the transmit loop element occupies a transmit loop area, and wherein the receive loop element occupies a receive loop area, and wherein the transmit loop area is opposite the receive loop area.

10. The small device antenna system of claim 8, wherein a number of transmit loop segments in the transmit loop zigzag configuration is equal to a number of receive loop segments in the receive loop zigzag configuration.

11. The small device antenna system of claim 8, wherein the transmit loop segments in the transmit loop zigzag configuration are distributed on either side of a transmit loop axis, and wherein the receive loop segments in the receive loop zigzag configuration are distributed on either side of a receive loop axis.

12. The small device antenna system of claim 8, wherein the transmit loop element is in a plane parallel to a plane of the receive loop element.

13. The small device antenna system of claim 8, wherein the transmit loop segments include one or more transmit loop connecting segments connected to one or more of the transmit loop segments that are disposed in a zigzag configuration.

14. The small device antenna system of claim 8, wherein a total path length of the transmit loop element is 1.55 times a wavelength of a center frequency of the transmit loop element, and wherein a total path length of the receive loop element is 1.55 times a wavelength of a center frequency of the receive loop element.

15. The small device antenna system of claim 14, wherein the center frequency of the transmit loop element and the receive loop element is between 2.0 GHz to 3.0 GHz, and wherein a total area of an orthographic projection of both the transmit loop element and the receive loop element on the insulating layer is less than 300 square millimeters.

16. The small device antenna system of claim 15, wherein the orthographic projection of both the transmit loop element and the receive loop element fits within a 15 millimeter square.

17. The small device antenna system of claim 15, wherein the transmit loop element and the receive loop element each have a maximum of 14 zigzags.

* * * * *